US011538301B2

(12) United States Patent
Nallaperumal et al.

(10) Patent No.: US 11,538,301 B2
(45) Date of Patent: Dec. 27, 2022

(54) PRIVILEGED ACCESS AND ANTI-THEFT PROTECTION FOR PREMISES USING LOCK BOX

(71) Applicant: Carrier Corporation, Palm Beach Gardens, FL (US)

(72) Inventors: Pirammanayagam Nallaperumal, Telangana (IN); Adam Kuenzi, Silverton, OR (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 530 days.

(21) Appl. No.: 16/423,809

(22) Filed: May 28, 2019

(65) Prior Publication Data

US 2019/0362575 A1 Nov. 28, 2019

(30) Foreign Application Priority Data

May 25, 2018 (IN) ..... 201811019614

(51) Int. Cl.
*G07C 9/00* (2020.01)
*E05B 19/00* (2006.01)

(52) U.S. Cl.
CPC ..... *G07C 9/00571* (2013.01); *E05B 19/0005* (2013.01); *G07C 9/00817* (2013.01); *G07C 2009/00825* (2013.01); *G07C 2009/00841* (2013.01)

(58) Field of Classification Search
CPC ..... E05B 19/0005; G07C 2009/00825; G07C 2009/00841; G07C 9/00571; G07C 9/00817; G07C 9/00912
See application file for complete search history.

(56) References Cited

U.S. PATENT DOCUMENTS

| | | | | |
|---|---|---|---|---|
| 4,766,746 | A * | 8/1988 | Henderson | G07C 9/21 340/5.73 |
| 6,842,105 | B1 * | 1/2005 | Henderson | G07C 9/215 70/278.1 |
| 7,009,489 | B2 | 3/2006 | Fisher | |
| 7,420,456 | B2 | 9/2008 | Fisher | |
| 8,437,740 | B2 | 5/2013 | Despain et al. | |
| 8,720,238 | B1 | 5/2014 | Davis | |
| 9,455,839 | B2 | 9/2016 | Conrad et al. | |
| 9,734,646 | B1 | 8/2017 | Noell | |
| 9,805,534 | B2 | 10/2017 | Ho et al. | |

(Continued)

FOREIGN PATENT DOCUMENTS

| | | | |
|---|---|---|---|
| MX | 2012012351 | A | 4/2014 |
| WO | 8705069 | A1 | 8/1987 |

OTHER PUBLICATIONS

Igloohome Pte Ltd, "Smart Keybox", available at: https://www.igloohome.co/products/keybox/, accessed May 28, 2019, 15 pages.

(Continued)

*Primary Examiner* — Yong Hang Jiang
(74) *Attorney, Agent, or Firm* — Cantor Colburn LLP

(57) ABSTRACT

A method is provided herein. The method includes disabling, by an electronic lock box, a programmable key based on the programmable key being placed in the electronic lock box. The method also includes enabling, by the electronic lock box, the programmable key based on the electronic lock box being accessed.

8 Claims, 4 Drawing Sheets

(56) References Cited

U.S. PATENT DOCUMENTS

| | | | | |
|---|---|---|---|---|
| 9,836,897 | B2 | 12/2017 | Briskey | |
| 2004/0025039 | A1 | 2/2004 | Kuenzi et al. | |
| 2005/0242930 | A1* | 11/2005 | Nicolson | E05B 19/0005 340/426.36 |
| 2007/0159297 | A1* | 7/2007 | Paulk | B60R 25/104 340/5.33 |
| 2008/0074235 | A1 | 3/2008 | Wong et al. | |
| 2008/0246587 | A1* | 10/2008 | Fisher | E05B 45/06 340/5.73 |
| 2013/0127594 | A1* | 5/2013 | Sato | G07C 9/00896 340/5.73 |
| 2015/0292239 | A1* | 10/2015 | Ng | E05B 19/0005 70/63 |
| 2016/0364929 | A1* | 12/2016 | Fisher | G07C 9/00309 |
| 2017/0050617 | A1* | 2/2017 | Penilla | G06Q 30/0643 |
| 2017/0228954 | A1* | 8/2017 | Evans | E05G 1/04 |
| 2017/0256111 | A1 | 9/2017 | Chung et al. | |
| 2020/0257330 | A1* | 8/2020 | Tieman | B60R 25/2072 |

OTHER PUBLICATIONS

Pires, Fernando, "Controlling Access to Keys and Cards with Key Control Systems", Morse Watchmans Incorporated—USA, dated Mar. 19, 2012, 4 pages.

* cited by examiner

PRIVILEGED ACCESS AND ANTI-THEFT PROTECTION FOR PREMISES USING LOCK BOX

FOREIGN PRIORITY

This application claims priority to Indian Patent Application No. 201811019614, filed May 25, 2018, and all the benefits accruing therefrom under 35 U.S.C. § 119, the contents of which in its entirety are herein incorporated by reference.

BACKGROUND

In general, conventional lock boxes store keys with full access to a premises or a vehicle and provide the keys to a user having valid credentials to open the conventional lock boxes. In this regard, conventional lock boxes are not be able to provide degrees of privileged access. Further, since a conventional lock box merely stores a key in what is usually an accessible location, conventional lock boxes have an inherent risk of theft and/or forced opening so that a user without the valid credentials can illegally access the premises.

BRIEF DESCRIPTION

In accordance with one or more embodiments, a method is provided herein. The method includes disabling, by an electronic lock box, a programmable key based on the programmable key being placed in the electronic lock box. The method also includes enabling, by the electronic lock box, the programmable key based on the electronic lock box being accessed.

In accordance with one or more embodiments or the method embodiment above, accessing the electronic lock box can include receiving credentials as an input via a mobile device.

In accordance with one or more embodiments or any of the method embodiments above, accessing the electronic lock box can include programing the programmable key.

In accordance with one or more embodiments or any of the method embodiments above, the electronic lock box can store access privileges in a memory to program the programmable key upon accessing the electronic lock box.

In accordance with one or more embodiments or any of the method embodiments above, the electronic lock box may not enable the programmable key due to a smashing of the electronic lock box.

In accordance with one or more embodiments or any of the method embodiments above, the programmable key can be pre-programmed with one of full access or limited access.

In accordance with one or more embodiments or any of the method embodiments above, the programmable key can include a power source that is enabled and/or disabled by the electronic lock box.

In accordance with one or more embodiments, a system is provided herein. The system includes a programmable key; and an electronic lock box configured to disable the programmable key based on the programmable key being placed in the electronic lock box and enable the programmable key based on the electronic lock box being accessed.

In accordance with one or more embodiments or the system embodiment above, accessing the electronic lock box can include receiving credentials as an input via a mobile device.

In accordance with one or more embodiments or any of the system embodiments above, accessing the electronic lock box can include programing the programmable key.

In accordance with one or more embodiments or any of the system embodiments above, the electronic lock box can store access privileges in a memory to program the programmable key upon accessing the electronic lock box.

In accordance with one or more embodiments or any of the system embodiments above, the electronic lock box may not enable the programmable key due to a smashing of the electronic lock box.

In accordance with one or more embodiments or any of the system embodiments above, the programmable key can be pre-programmed with one of full access or limited access.

In accordance with one or more embodiments or any of the system embodiments above, the programmable key can include a power source that is enabled and/or disabled by the electronic lock box.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

In general, one or more embodiments include an electronic lock box storing a programmable key therein. The programmable key on initial storage is disabled (e.g., off, blank, and/or not programmed). Upon access to the electronic lock box with valid credentials, the electronic lock box enables the programmable key so that the programmable key is now authorized to access an access control that controls access to a premises. The technical effect and benefits of the one or more embodiments include allowing a user to utilize any programmable key system (e.g., lock/fob system) that can include degrees of privileged access based on the valid credentials. The technical effect and benefits of the one or more embodiments also include eliminating the conventional lock box susceptibility to theft and/or forced opening, as stealing the disabled programmable key would not allow access to the premises.

Figure 1:
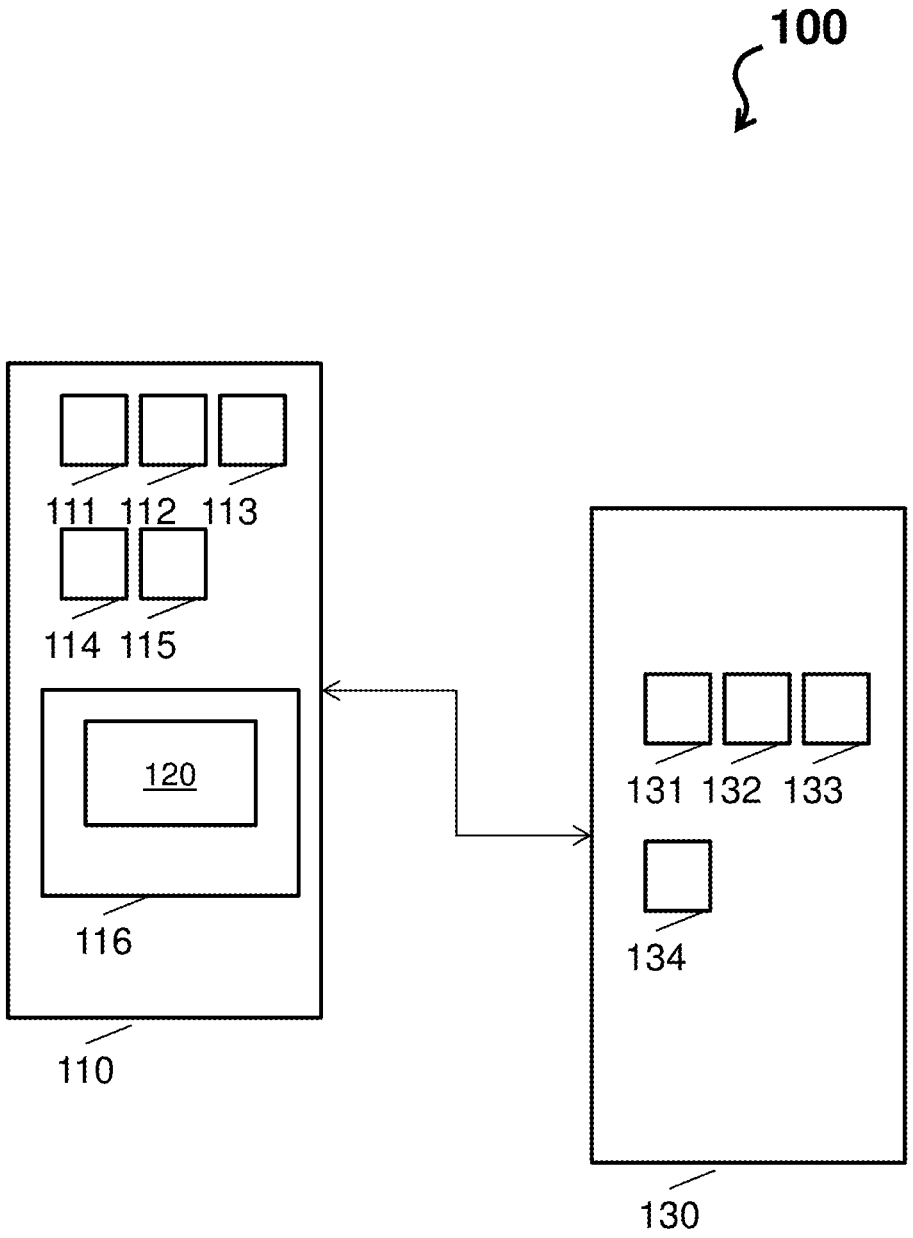
FIG. 1 depicts a system in accordance with one or more embodiments.

Turning now to FIG. 1, a system 100 is depicted in accordance with one or more embodiments. The system 100 comprises an electronic lock box 110 including a processor 111, a memory 112, an interface 113, a power source 114, a locking mechanism 115, and a chamber 116. The system 100 can comprise a programmable key 120 that can be stored in the chamber 116 of the electronic lock box 110. The system 100 comprises a mobile device 130 including a processor 131, a memory 132, an interface 133, and a power source 134. In accordance with one or more embodiments, the system 100 herein can be utilized for real estate access, automobile access, storage locker access, and the like.

The electronic lock box 110 can be any electro-mechanical lock box for securely storing the programmable key 120. The processor 111, the memory 112, and the interface 113 can work collectively based on software to enable and/disable the programmable key 120 in accordance with receiving valid credentials. The processor 111, the memory 112, and the interface 113 can also work collectively to program the programmable key 120 in accordance with receiving valid credentials.

In accordance with one or more embodiments, data to program the programmable key 120 can be pre-programmed into the electronic lock box 110 when it is commissioned to be positioned on a particular home for sale or on a particular vehicle. In accordance with one or more embodiments, the data to program the programmable key 120 can be delivered with the valid credentials and/or retrieved from an encrypted dataset inside the valid credentials. In accordance with one or more embodiments, the data can be pre-resident on the programmable key 120, where an authorized 'disable/enable' feature of the programmable key 120 is used by the electronic lock box 110 to enable/disable the programmable key 120. The memory 112 of the electronic lock box 110 can store degrees of privileges (full access vs. limited access), which can be used to program the programmable key 120 based on receiving valid credentials (receiving home owner credentials vs. real estate agent credentials, respectively).

In accordance with one or more embodiments, the electronic lock box 110 can comprise a lock box that can be opened by a radio frequency identification (RFID) card, where the programming of the programmable key 120 is performed with respect to the RFID card.

The power source 114 can be any power generation/storage medium, such as a battery or solar panel, which provides electricity to the processor 111, the memory 112, and the interface 113.

The locking mechanism 115 can be an electro-mechanical lock that enables a door of the chamber 116 to open or close. In accordance with one or more embodiments, the locking mechanism 115 and the chamber can combine to be a compartment to be released from the electronic lock box 110. Further, the compartment may be fully removable. Note that the programmable key 120 is not retrievable unless the electronic lock box 110 releases the locking mechanism 115 to allow access to the programmable key 120.

The programmable key 120 inside the electronic lock box 110 can be a key fob, an RFID card, a near field communication card, or beacon that can be configurable through the interface 113 of the electronic lock box 110 (e.g., a Bluetooth connection). The programmable key 120 can be pre-programed before being placed in the chamber 116 or programmed in real time upon access to the chamber 116. The programmable key 120 can include a power source that is enabled and/or disabled by the electronic lock box 110, along with an interface, a memory, and a processor as described herein for storing and executing firmware.

The mobile device 130 can be any computer system including the processor 131, the memory 132, the interface 133, and the power source 134. Examples of the mobile device 130 include a mobile phone, a tablet computer, a smart phone, a laptop, a fob device (for a car or a door lock), an RFID card, and a near field communication card.

Figure 2:
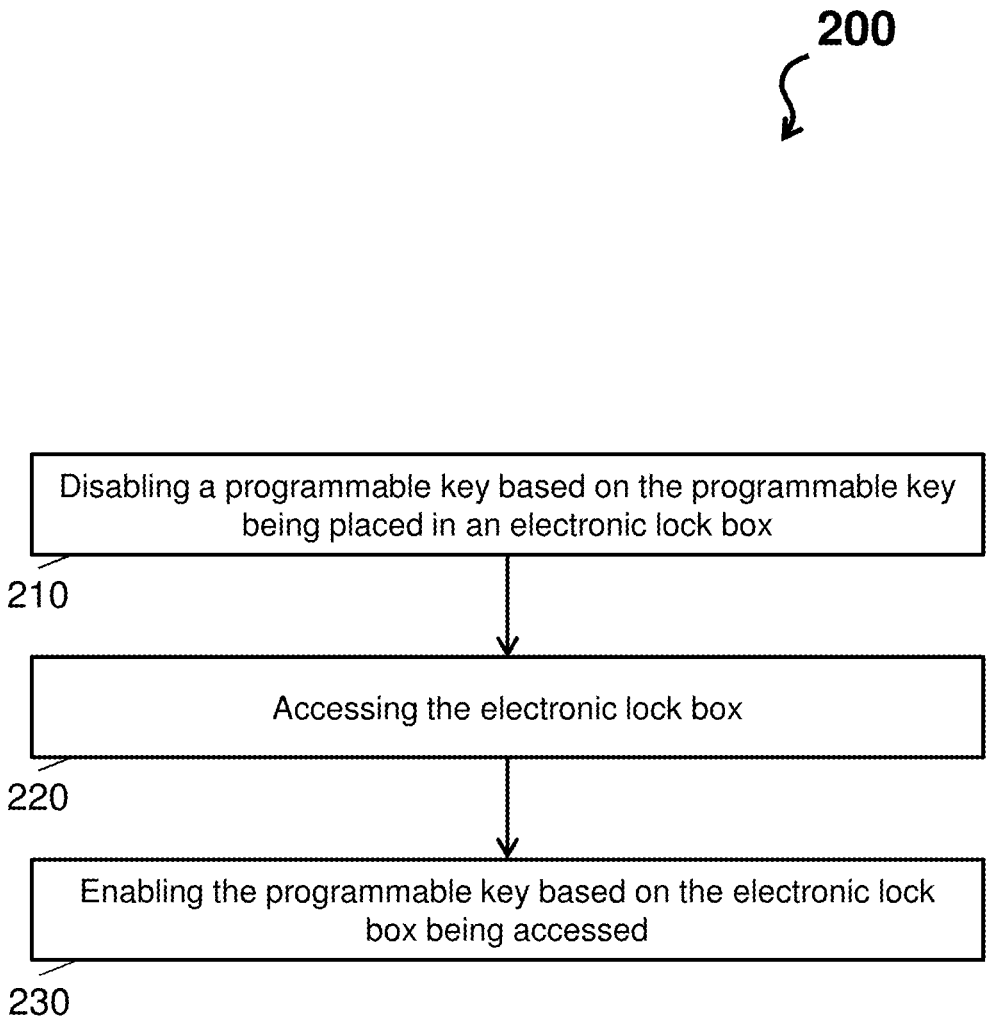
FIG. 2 depicts a process flow of a system in accordance with one or more embodiments.

FIG. 2 depicts a process flow 200 of a system 100 in accordance with one or more embodiments. The process flow 200, in general, includes an ability to detect a closure of the electronic lock box 110 and/or to detect an insertion of the programmable key 120. In accordance with one or more embodiments, if the programmable key 120 comprises RFID and the interface 113 comprises an RFID antenna coil, then the electronic lock box 110 can detect the insertion/closure while reading the programmable key 120. Upon detection, the process flow 400 proceeds to block 210. In accordance with one or more embodiments, if the programmable key 120 comprises a Bluetooth device and the interface 113 comprises a Bluetooth antenna, then electronic lock box 110 can listen to or communicate with the Bluetooth device. Other sensor-device combination are contemplated herein.

The process flow begins at block 210, where the electronic lock box 110 disables the programmable key 120 based on the programmable key 120 being placed in the electronic lock box 110.

At block 220, the electronic lock box 110 is accessed. Accessing the electronic lock box 110 can include unlocking the electronic lock box 110. The electronic lock box 110 can be accessed by a user utilizing a combination code provided to the locking mechanism 115, based on a mobile application communicating of the mobile device 130 to the interface 113, etc. Further, the electronic lock box 110 can be accessed by a user utilizing an RFID, near field communication card, a keypad, or other mechanism (e.g., an Internet of system, etc.).

At block 230, the electronic lock box 110 enables the programmable key 120 based on the electronic lock box 110 being accessed. Further, the electronic lock box 110 enables the programmable key 120 by using an authentication mechanism with respect to the programmable key 120 that causes the electronic lock box 110 to enable a power source of the programmable key 120. In accordance with one or more embodiments, when a user of a premises unlocks the electronic lock box 110, the electronic lock box 110 programs the programmable key 120 inside the chamber 116 before releasing the programmable key 120. In accordance with one or more embodiments, programming the programmable key 120 can comprise communicating with the programmable key 120 over the interface 130 (e.g., via Bluetooth, near field communication, RFID, etc.), authenticating to the programmable key 120 with a secret, key, and/or password known to the electronic lock box 110 and the programmable key 120, and providing data to the programmable key 120 to indicate state (e.g., disabled/enabled) and privileges (e.g., access codes, electronic keys, etc.), both of which are further discussed with respect to FIG. 4. Now the user can use the programmable key 120 to unlock at least one door of the premises.

In accordance with one or more embodiments, the at least one door of the premise can comprise an electronic locking mechanism operable by the programmable key 120. For instance, the electronic locking mechanism can comprise a memory, interfaces, and processors so that when the programmable key 120, that has been programmed, is presented to the electronic locking mechanism, the electronic locking mechanism validates the programmable key 120 and opens the at least one door of the premise. Examples of the at least one door of the premise comprising the electronic locking mechanism include, but are not limited to, smart door locks, vehicle doors (e.g., vehicle utilizing key fobs), and hotel doors that open with RFID cards.

Figure 3:
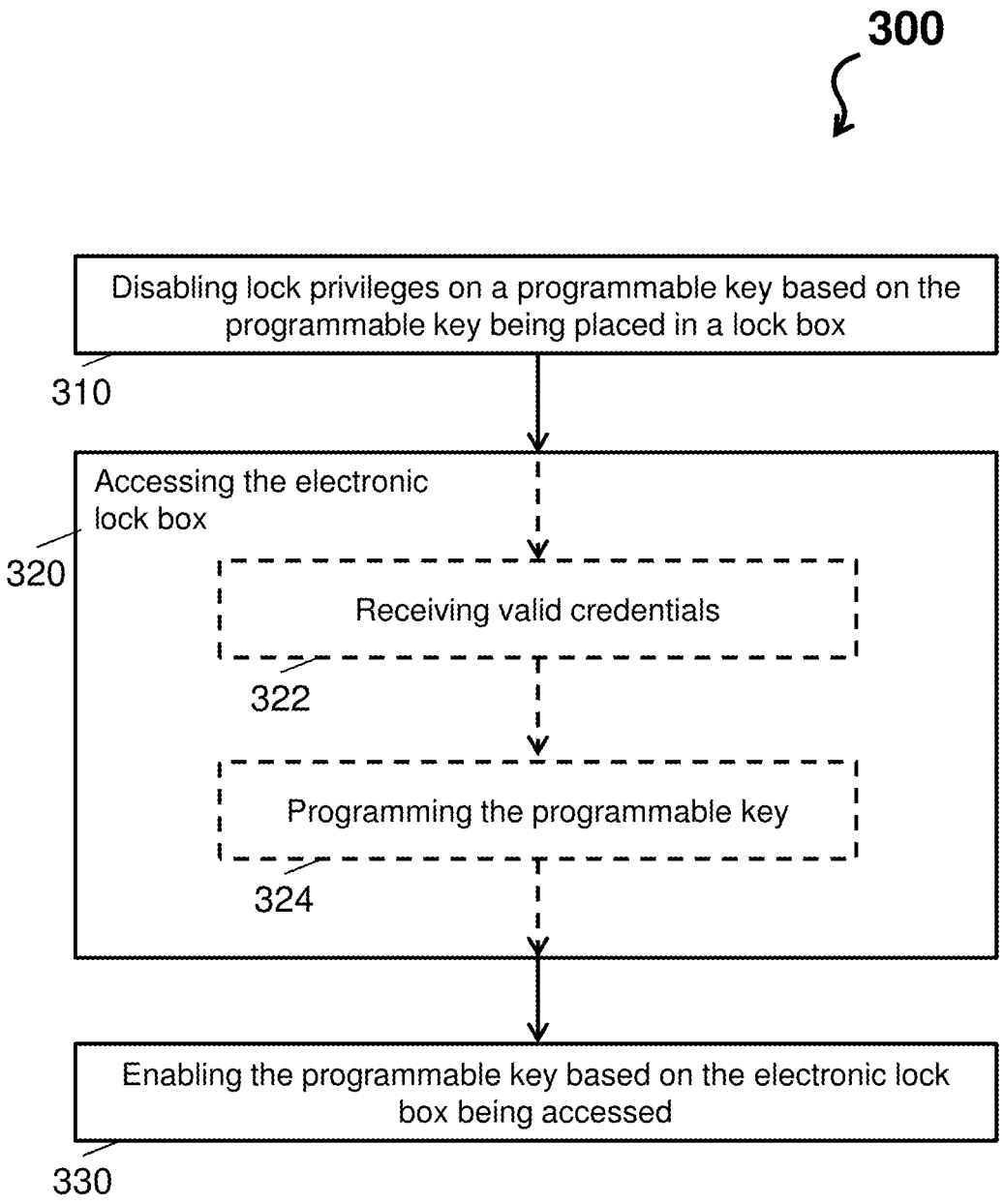
FIG. 3 depicts a process flow of a system in accordance with one or more embodiments.

FIG. 3 depicts a process flow 300 of a system 300 in accordance with one or more embodiments. The process flow begins at block 310, where the electronic lock box 110 disables the programmable key 120 based on the programmable key 120 being placed in the electronic lock box 110.

At block 320, the electronic lock box 110 is accessed. Accessing the electronic lock box 110 can include operations with respect to dashed blocks 322 and 324. At dashed-block 322, the electronic lock box 110 receives credentials (from an RFID, near field communication card, a keypad, or other mechanism). At dashed-block 324, the electronic lock box 110 programs the programmable key 120. In accordance with one or more embodiments, programming the programmable key 120 can comprise communicating with the programmable key 120 over the interface 130 (e.g., via Bluetooth, near field communication, RFID, etc.), authenticating to the programmable key 120 with a secret, key, and/or password known to the electronic lock box 110 and the programmable key 120, and providing data to the programmable key 120 to indicate state (e.g., disabled/enabled) and privileges (e.g., access codes, electronic keys, etc.), both of which are further discussed with respect to FIG. 4. In accordance with one or more embodiments, programming the programmable key 120 can comprise storing an access code in the electronic lock box 110 and writing the access code into the programmable key 120. Further, an encryption key can be used to authenticate the programmable key 120 with the electronic lock box 110.

At block 330, the electronic lock box 110 enables the programmable key 120 based on the electronic lock box 110 being accessed and the programmable key 120 being programmed.

Figure 4:
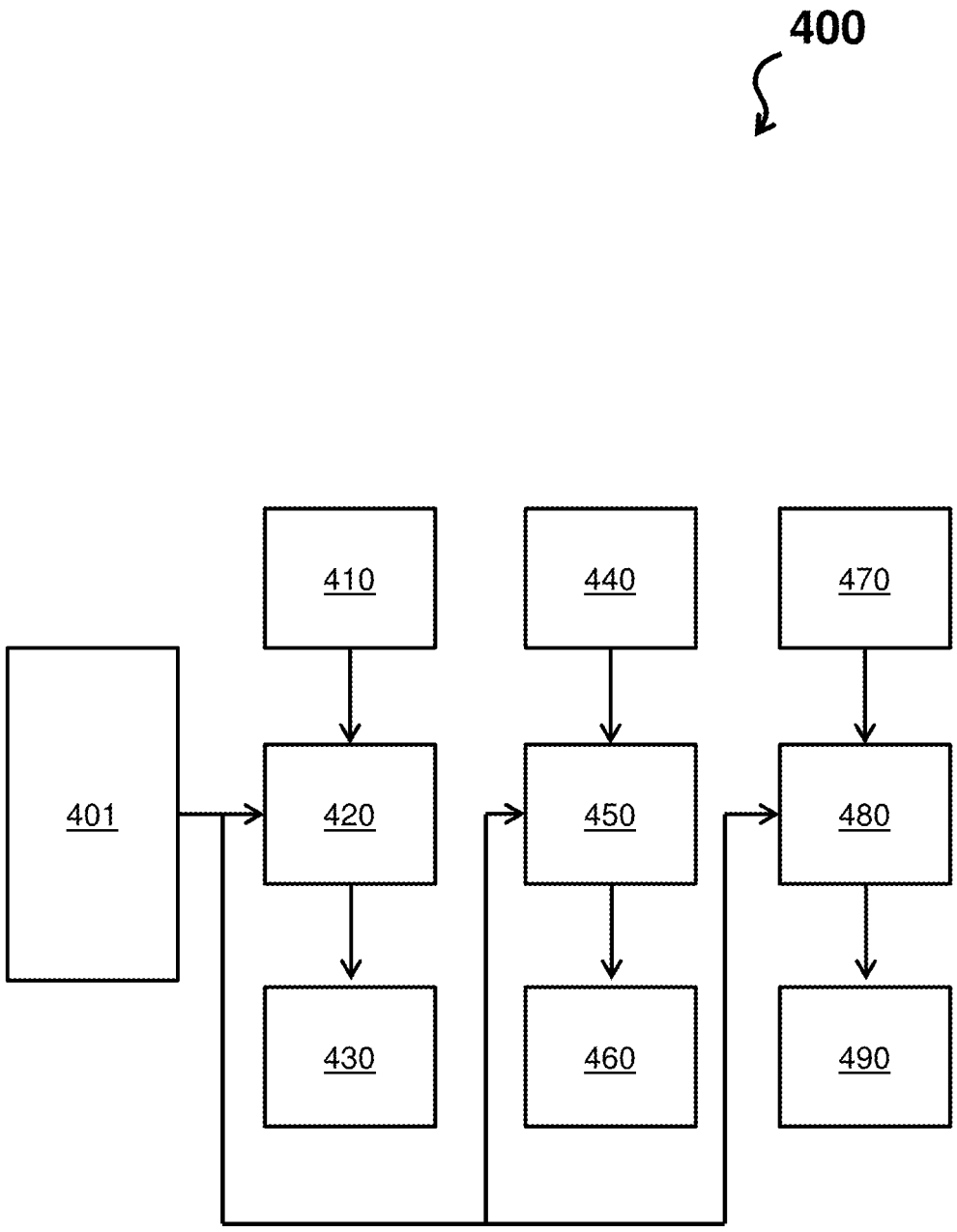
FIG. 4 depicts a schematic process in accordance with one or more embodiments.

FIG. 4 depicts a schematic process 400 in accordance with one or more embodiments. At block 401 of the schematic process 400, the programmable key 120 within the electronic lock box 110 is programmed with no access privileges to a premises as soon as the programmable key 120 is placed in the electronic lock box 110. Note that the three columns of blocks are independent scenarios, where the electronic lock box 110 is programming the programmable key 120 differently in each scenario.

At block 410 of the schematic process 400, a home owner unlocks the electronic lock box 110 with a mobile application of the mobile device 130. At block 420 of the schematic process 400, the electronic lock box 110 programs with the programmable key 120 with full access privileges. At block 430 of the schematic process 400, the home owner can access an entire premises.

At block 440 of the schematic process 400, a real estate agent unlocks the electronic lock box 110 with a mobile application of the mobile device 130. At block 450 of the schematic process 400, the electronic lock box 110 programs with the programmable key 120 with limited access privileges. At block 460 of the schematic process 400, the real estate agent can access a limited area of the premises (e.g., excluding a computer room).

At block 470 of the schematic process 400, a bugler smashes the electronic lock box 110 and access the programmable key 120. At block 480 of the schematic process 400, the electronic lock box 110 does not enable or program the programmable key 120 due to the smashing. At block 490 of the schematic process 400, the burglar cannot access any area of the premises with the stolen programmable key 120.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method comprising disabling, by an electronic lock box, a programmable key based on the programmable key being placed in the electronic lock box; and enabling, by the electronic lock box, the programmable key based on the electronic lock box being accessed;

wherein accessing the electronic lock box comprises receiving credentials as an input via a mobile device;

wherein the electronic lock box stores access privileges in a memory to program the programmable key upon accessing the electronic lock box;

wherein different access privileges are programmed to the programmable key in response to different credentials received at the electronic lock box.

2. The method of claim 1, wherein the electronic lock box does not enable the programmable key due to a smashing of the electronic lock box.

3. The method of claim 1, wherein the different access privileges include one of full access or limited access.

4. The method of claim 1, wherein the programmable key comprises a power source that is enabled and/or disabled by the electronic lock box.

5. A system comprising:

a programmable key; and an electronic lock box configured to disable the programmable key based on the programmable key being placed in the electronic lock box and enable the programmable key based on the electronic lock box being accessed;

wherein accessing the electronic lock box comprises receiving credentials as an input via a mobile device;

wherein the electronic lock box stores access privileges in a memory to program the programmable key upon accessing the electronic lock box;

wherein different access privileges are programmed to the programmable key in response to different credentials received at the electronic lock box.

6. The system of claim 5, wherein the electronic lock box does not enable the programmable key due to a smashing of the electronic lock box.

7. The system of claim 5, wherein the different access privileges include one of full access or limited access.

8. The system of claim 5, wherein the programmable key comprises a power source that is enabled and/or disabled by the electronic lock box.

* * * * *